US009574139B2

(12) United States Patent
Broderick et al.

(10) Patent No.: US 9,574,139 B2
(45) Date of Patent: Feb. 21, 2017

(54) CONTAMINANT REMOVAL FROM HYDROCARBON STREAMS WITH LEWIS ACIDIC IONIC LIQUIDS

(71) Applicant: UOP LLC, Des Plaines, IL (US)

(72) Inventors: Erin M. Broderick, Arlington Heights, IL (US); Alakananda Bhattacharyya, Glen Ellyn, IL (US); Shurong Yang, Naperville, IL (US); Beckay J. Mezza, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 155 days.

(21) Appl. No.: 14/552,345

(22) Filed: Nov. 24, 2014

(65) Prior Publication Data

US 2016/0145500 A1 May 26, 2016

(51) Int. Cl.

| | |
|---|---|
| ***C10G 17/04*** | (2006.01) |
| ***C10G 17/07*** | (2006.01) |
| ***C10G 55/06*** | (2006.01) |
| ***C10G 67/08*** | (2006.01) |
| *C10G 17/00* | (2006.01) |
| *C10G 17/02* | (2006.01) |

(52) U.S. Cl.
CPC ..... *C10G 17/07* (2013.01); *C10G 55/06* (2013.01); *C10G 67/08* (2013.01)

(58) Field of Classification Search
CPC ..... C10G 17/00; C10G 17/02; C10G 17/04; C10G 17/07; C10G 55/06; C10G 67/08
See application file for complete search history.

(56) References Cited

U.S. PATENT DOCUMENTS

| | | | |
|---|---|---|---|
| 7,001,504 | B2 | 2/2006 | Schoonover |
| 7,553,406 | B2 | 6/2009 | Wasserscheid et al. |
| 7,749,377 | B2 | 7/2010 | Serban et al. |
| 7,988,747 | B2 | 8/2011 | Lacheen et al. |
| 8,075,803 | B2 | 12/2011 | Kalb |
| 8,540,871 | B2 | 9/2013 | Zhan et al. |
| 8,597,517 | B2 | 12/2013 | Guzman Lucero et al. |
| 2010/0270211 | A1 | 10/2010 | Wolny |
| 2013/0026073 | A1 | 1/2013 | Martinez Palou et al. |

(Continued)

FOREIGN PATENT DOCUMENTS

| | | | |
|---|---|---|---|
| CN | 102443421 | A | 5/2010 |
| CN | 101210199 | B | 12/2010 |

(Continued)

OTHER PUBLICATIONS

Gary, J.H. et al. (2007). Petroleum Refining Technology and Economics, 5th ed., Taylor & Francis, 463 pgs (Office action cites p. 3).*

(Continued)

*Primary Examiner* — Brian McCaig

(57) ABSTRACT

Processes for removing sulfur and nitrogen contaminants from hydrocarbon streams are described. The processes include contacting the hydrocarbon stream comprising the contaminant with lean halometallate ionic liquid an organohalide resulting in a mixture comprising the hydrocarbon and rich halometallate ionic liquid comprising the contaminant. The mixture is separated to produce a hydrocarbon effluent and a rich halometallate ionic liquid effluent comprising the rich halometallate ionic liquid comprising the contaminant.

18 Claims, 2 Drawing Sheets

(56) References Cited

U.S. PATENT DOCUMENTS

| | | | |
|---|---|---|---|
| 2013/0118955 | A1 | 5/2013 | Victorovna Likhanova et al. |
| 2013/0248423 | A1 | 9/2013 | Serban et al. |

FOREIGN PATENT DOCUMENTS

| | | | |
|---|---|---|---|
| CN | 101338221 | B | 7/2011 |
| CN | 102453524 | A | 5/2012 |
| CN | 102732287 | A | 10/2012 |
| JP | 2005314500 | A2 | 11/2005 |
| WO | WO 02/34863 | A1 | 5/2002 |

OTHER PUBLICATIONS

Chen et al., "Deep oxidative desulfurization of diesel fuels by Lewis acidic ionic liquids," Journal of Molecular Catalysis A: Chemical (2012), vol. 359, 8-13.

Wang et al., "The Extractive Desulfurization of Fuels Using ionic Liquids Based on FeCl3," Petroleum Science and Technology (2010), 28(12), 1203-1210.

Zhang et al., "Extractive Desulfurization and Denitrogenation of Fuels Using Ionic Liquids," Industrial and Engineering Chemistry Research (2004), 43(2), 614-622.

Schmidt, Roland, "[bmim]AlCl4 Ionic Liquid for Deep Desulfurization of Real Fuels," Energy and Fuels (2008), 22(3), 1774-1778.

Jiang et al.,"Thermodynamic Properties of Caprolactam Ionic Liquids," Chinese Journal of Chemical Engineering (2013), 21(7), 766-769.

Huh et al., "Selective denitrogenation using Zn-containing ionic liquids as extractants," ACS National Meeting Book of Abstracts (2009), American Chemical Society—238th.

Jess et al., "Use of ionic liquids for desulfurization of product streams in crude oil treatment," Chemie-Ingenieur-Technik (2004), 76(9), 1407-1408.

Geo et al., "A Carboniurn Pseudo Ionic Liquid with Excellent Extractive Desuifurization Performance," AlChE Journal, vol. 59, No. 3, Mar. 2013, pp. 948-958.

Gao et al., "Acylation Desulfurization of Oil Via Reactive Adsorption," AlChE Journal, vol. 59, No. 8, Aug. 2013, pp. 2966-2976.

Dharakskar et al., "Extractive Deep Desulfurization of Liquid Fuels Using Lewis-Based ionic Liquids," Journal of Energy (2013), 4 pages.

Nie et al., "Fast oxidative desulfurization of fuel oil using dialkyloyddinium tetrachioroferrates ionic liquids," Fuel (2013), vol. 103, 997-1002.

Dong et al., "Highly efficient oxidative desulfurization of fuels byiewis acidic ionic liquids . . .," Chemical Engineering & Technology (2013), 36(3), 435-442.

Yu et al., "Deep oxidative desulfurization of diesel fuels by acidic ionic liquids," Industrial & Engineering Chemistry Research (2011), vol. 50, 11690-11697.

Gao et al., "Desulfurization of diesel fuel by extraction with Lewis-acidic ionic liquid," Separation Science and Technology (2009), 44(4), 971-982.

* cited by examiner

CONTAMINANT REMOVAL FROM HYDROCARBON STREAMS WITH LEWIS ACIDIC IONIC LIQUIDS

BACKGROUND OF THE INVENTION

Various hydrocarbon streams, such as vacuum gas oil (VGO), light cycle oil (LCO), and naphtha, may be converted into higher value hydrocarbon fractions such as diesel fuel, jet fuel, naphtha, gasoline, and other lower boiling fractions in refining processes such as hydrocracking and fluid catalytic cracking (FCC). However, hydrocarbon feed streams for these materials often have high amounts of nitrogen which are more difficult to convert. For example, the degree of conversion, product yields, catalyst deactivation, and/or ability to meet product quality specifications may be adversely affected by the nitrogen content of the feed stream. It is known to reduce the nitrogen content of these hydrocarbon feed streams by catalytic hydrogenation reactions such as in a hydrotreating process unit. However, hydrogenation processes require high pressures and temperatures.

Various processes using ionic liquids to remove sulfur and nitrogen compounds from hydrocarbon fractions are also known. U.S. Pat. No. 7,001,504 discloses a process for the removal of organosulfur compounds from hydrocarbon materials which includes contacting an ionic liquid with a hydrocarbon material to extract sulfur containing compounds into the ionic liquid. U.S. Pat. No. 7,553,406 discloses a process for removing polarizable impurities from hydrocarbons and mixtures of hydrocarbons using ionic liquids as an extraction medium. U.S. Pat. No. 7,553,406 also discloses that different ionic liquids show different extractive properties for different polarizable compounds.

Sulfur extraction has also been reported using Lewis hard acid $AlCl_3$ combined with tert-butyl chloride, n-butyl chloride, and tert-butyl bromide, A Carbonium Pseudo Ionic Liquid with Excellent Extractive Desulfurization Performance, AIChE Journal, Vol. 59, No. 3, p. 948-958, March 2013; and acylating reagents and Lewis acids, Acylation Desulfurization of Oil Via Reactive Adsorption, AIChE Journal, Vol. 59, No. 8, p. 2966-2976, August 2013.

There remains a need in the art for improved processes that enable the removal of contaminants from hydrocarbon streams.

SUMMARY OF THE INVENTION

One aspect of the invention is process for removing a contaminant comprising at least one of sulfur and nitrogen from a hydrocarbon stream. In one embodiment, the process includes contacting the hydrocarbon stream comprising the contaminant with a lean hydrocarbon-immiscible halometallate ionic liquid and an organohalide or HCl resulting in a mixture comprising the hydrocarbon and a rich hydrocarbon-immiscible halometallate ionic liquid comprising the contaminant. The mixture is separated to produce a hydrocarbon effluent and a rich hydrocarbon-immiscible halometallate ionic liquid effluent comprising the rich hydrocarbon-immiscible halometallate ionic liquid comprising the contaminant.

DETAILED DESCRIPTION OF THE INVENTION

Figure 1:
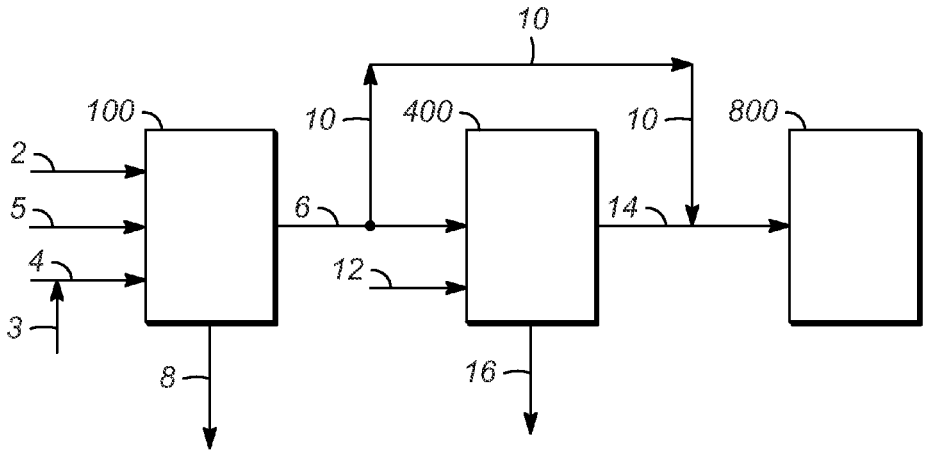
FIG. 1 is a simplified flow scheme illustrating various embodiments of the invention.

In general, the invention may be used to remove sulfur and nitrogen contaminants from a hydrocarbon stream using a halometallate ionic liquid. The number of acid sites of the halometallate ionic liquid was increased using an organohalide or HCl, which improved the sulfur removal compared to the halometallate ionic liquid alone.

The hydrocarbon stream typically has a boiling point in the range of about 30° C. to about 610° C. Examples of hydrocarbon streams include, but are not limited to, at least one of vacuum gas oil streams (boiling point (BP) of about 263° C. to about 583° C.), light cycle oil streams (BP of about 103° C. to about 403° C.), naphtha streams (BP of about 30° C. to about 200° C.), coker gas oil streams (BP of about 263° C. to about 603° C.), kerosene streams (BP of about 150° C. to about 275° C.), streams made from biorenewable sources, fracking condensate streams, streams from hydrocracking zones, streams from hydrotreating zones, and streams from fluid catalytic cracking zones.

The sulfur and nitrogen contaminants are one or more species found in the hydrocarbon material that is detrimental to further processing. The total sulfur content may range from 0.1 to 7 wt %, and the nitrogen content may be from about 40 ppm to 30,000 ppm.

The halometallate ionic liquid and organohalide can remove one or more of the sulfur and nitrogen contaminants in the hydrocarbon feed. The hydrocarbon feed will usually comprise a plurality of nitrogen compounds of different types in various amounts. Thus, at least a portion of at least one type of nitrogen compound may be removed from the hydrocarbon feed. The same or different amounts of each type of nitrogen compound can be removed, and some types of nitrogen compounds may not be removed. In an embodiment, up to about 99 wt % of the nitrogen can be removed. The nitrogen content of the hydrocarbon feed is typically reduced by at least about 10 wt %, at least about 20 wt %, or at least about 30 wt %, or at least about 40 wt %, at least about 50 wt %, or at least about 60 wt %, or at least about 70 wt %, or at least about 80 wt %, or at least about 90 wt %, or at least about 95 wt %, or at least about 96 wt %, or at least about 97 wt %, or at least about 98 wt %.

The hydrocarbon feed will typically also comprise a plurality of sulfur compounds of different types in various amounts. Thus, at least a portion of at least one type of sulfur compound may be removed from the hydrocarbon feed. The same or different amounts of each type of sulfur compound may be removed, and some types of sulfur compounds may not be removed. In an embodiment, up to about 99 wt % of the sulfur can be removed. Typically, the sulfur content of the hydrocarbon feed is reduced by at least about 10 wt %, or at least about 15 wt %, or at least 20 wt %, or at least 25 wt %, or at least 30 wt %, or at least 35 wt %, or at least 40 wt %, or at least 50 wt %, or at least 60 wt %, or at least 70 wt %, or at least 80 wt %, or at least 90 wt %, or at least 95 wt %.

Halometallate ionic liquids suitable for use in the instant invention are hydrocarbon feed-immiscible halometallate ionic liquids. As used herein the term "hydrocarbon feed-immiscible halometallate ionic liquid" means the halometallate ionic liquid is capable of forming a separate phase from hydrocarbon feed under the operating conditions of the process. Halometallate ionic liquids that are miscible with hydrocarbon feed at the process conditions will be completely soluble with the hydrocarbon feed; therefore, no phase separation will be feasible. Thus, hydrocarbon feed-immiscible halometallate ionic liquids may be insoluble with or partially soluble with the hydrocarbon feed under the operating conditions. A halometallate ionic liquid capable of forming a separate phase from the hydrocarbon feed under the operating conditions is considered to be hydrocarbon feed-immiscible. Halometallate ionic liquids according to the invention may be insoluble, partially soluble, or completely soluble (miscible) with water.

Consistent with common terms of art, the halometallate ionic liquid introduced to the contaminant removal zone may be referred to as a "lean" halometallate ionic liquid generally meaning a hydrocarbon feed-immiscible halometallate ionic liquid that is not saturated with one or more extracted contaminants. Lean halometallate ionic liquid may include one or both of fresh and regenerated halometallate ionic liquid and is suitable for accepting or extracting contaminants from the hydrocarbon feed. Likewise, the halometallate ionic liquid effluent may be referred to as "rich", which generally means a hydrocarbon feed-immiscible halometallate ionic liquid effluent produced by a contaminant removal step or process or otherwise including a greater amount of extracted contaminants than the amount of extracted contaminants included in the lean halometallate ionic liquid. A rich halometallate ionic liquid may require regeneration or dilution, e.g. with fresh halometallate ionic liquid, before recycling the rich halometallate ionic liquid to the same or another contaminant removal step of the process.

Generally, ionic liquids are non-aqueous, organic salts composed of ions where the positive ion is charge balanced with a negative ion. These materials have low melting points, often below 100° C., undetectable vapor pressure, and good chemical and thermal stability. The cationic charge of the salt is localized over hetero atoms, such as nitrogen, phosphorous, sulfur, arsenic, boron, antimony, and aluminum, and the anions may be any inorganic, organic, or organometallic species.

The halometallate ionic liquid comprises haloaluminate ionic liquids, haloferrate ionic liquids, halocuprate ionic liquids, halozincate ionic liquids, or combinations thereof. The ratio of the cation to anion is typically 1:1. The halometallate anion can have a range of metal content. In some embodiments, the metal is aluminum, with the mole fraction of aluminum ranging from $0<Al<0.25$ in the anion. Suitable anions include, but are not limited to, $AlCl_4^-$, $Al_2Cl_7^-$, $Al_3Cl_{10}^-$, $AlCl_3Br^-$, $Al_2Cl_6Br^-$, $Al_3Cl_9Br^-$, $AlBr_4^-$, $Al_2Br_7^-$, and $Al_3Br_{10}$.

The halometallate ionic liquid comprises at least one of nitrogen containing ionic liquids and phosphorus containing ionic liquids. In an embodiment, the hydrocarbon feed-immiscible ionic liquid comprises at least one of an imidazolium ionic liquid, a pyridinium ionic liquid, a phosphonium ionic liquid, a lactamium ionic liquid, an ammonium ionic liquid, and a pyrrolidinium ionic liquid. In another embodiment, the hydrocarbon feed-immiscible ionic liquid consists essentially of imidazolium ionic liquids, pyridinium ionic liquids, phosphonium ionic liquids, lactamium ionic liquids, ammonium ionic liquids, pyrrolidinium ionic liquids, and combinations thereof. In still another embodiment, the hydrocarbon feed-immiscible ionic liquid is selected from the group consisting of imidazolium ionic liquids, pyridinium ionic liquids, phosphonium ionic liquids, lactamium ionic liquids, ammonium ionic liquids, pyrrolidinium ionic liquids, and combinations thereof. Imidazolium, pyridinium, lactamium, ammonium, and pyrrolidinium ionic liquids have a cation comprising at least one nitrogen atom. Phosphonium ionic liquids have a cation comprising at least one phosphorous atom. Lactamium ionic liquids include, but are not limited to, those described in U.S. Pat. No. 8,709,236, U.S. application Ser. No. 14/271,308, entitled Synthesis of Lactam Based Ionic Liquids, filed May 6, 2014, and U.S. application Ser. No. 14/271,319, entitled Synthesis of N-Derivatized Lactam Based Ionic Liquids, filed May 6, 2014, which are incorporated by reference.

In an embodiment, the hydrocarbon feed-immiscible ionic liquid comprises at least one of 1-ethyl-3-methylimidazolium ethyl sulfate, 1-butyl-3-methylimidazolium hydrogen sulfate, 1-ethyl-3-methylimidazolium chloride, 1-butyl-3-methylimidazolium chloride, 1-butyl-3-methylimidazolium trifluoromethanesulfonate, 1-ethyl-3-methylimidazolium bis(trifluoromethylsulfonyl)imide, 1-butyl-3-methylimidazolium hexafluorophosphate, 1-butyl-3-methylimidazolium tetrafluoroborate, methylimidazolium trifluoroacetate, 1-butyl-3-methylimidazolium bromide, 1-ethyl-3-methylimidazolium trifluoroacetate, 1-methylimidazolium hydrogen sulfate, 1-butyl-4-methylpyridinium chloride, N-butyl-3-methylpyridinium methylsulfate, 1-butyl-4-methylpyridinium hexafluorophosphate, pyridinium p-toluene sulfonate, 1-butylpyridinium chloride, tetraethylammonium acetate, trihexyl(tetradecyl)phosphonium chloride, trihexyl(tetradecyl)phosphonium bromide, tributyl(tetradecyl)phosphonium chloride, tributyl(tetradecyl)phosphonium bromide, tributyl(methyl)phosphonium bromide, tributyl(methyl)phosphonium chloride, tripropyl(hexyl)phosphonium bromide, tripropyl(hexyl)phosphonium chloride, tributyl(hexyl)phosphonium bromide, tributyl(hexyl)phosphonium chloride, tributyl(pentyl)phosphonium bromide, tributyl(pentyl)phosphonium chloride, tributyl(octyl)phosphonium bromide, tributyl(octyl)phosphonium chloride, tributyl(decyl)phosphonium bromide, tributyl(decyl)phosphonium chloride, tributyl(dodecyl)phosphonium bromide, tributyl(dodecyl)phosphonium chloride, tetrabutylphosphonium bromide, tetrabutylphosphonium chloride, triisobutyl(methyl)phosphonium tosylate, tributyl(ethyl)phosphonium diethylphosphate, tetrabutylphosphonium methanesulfonate, pyridinium p-toluene sulfonate, tributyl(methyl)phosphonium methylsulfate.

An organohalide or HCl can be used to increase the number of acid sites of the halometallate ionic liquid. Suitable organohalides include alkyl halides, isoalkyl halides, and cycloalkyl halides, or combinations thereof. In some embodiments, the organohalides can have 1-12 carbon atoms. The halides can be chlorides, bromides, iodides, fluorides, or combinations thereof. Suitable organohalides include, but are not limited to, tert-butyl chloride, tert-butyl bromide, 2-chlorobutane, 2-bromobutane, cyclopentyl chloride, cyclopentyl bromide, butyl chloride, butyl bromide, propyl chloride, propyl bromide, or combinations thereof. The organohalide is present in an amount between about 1 wt % and about 50 wt % of the amount of ionic liquid, or about 5 wt % and about 40 wt %, or about 10 wt % and about 30 wt %, or about 15 wt % and about 25 wt %.

In an embodiment, the invention is a process for removing sulfur and nitrogen contaminants from a hydrocarbon feed stream comprising a contacting step and a separating step. In the contacting step, a hydrocarbon feed stream comprising a contaminant, a hydrocarbon-immiscible halometallate ionic liquid and an organohalide are contacted or mixed. The contacting may facilitate transfer or extraction of the one or more contaminants from the hydrocarbon feed stream to the halometallate ionic liquid. Although a halometallate ionic liquid that is partially soluble in the hydrocarbon may facilitate transfer of the contaminant from the hydrocarbon to the halometallate ionic liquid, partial solubility is not required. Insoluble hydrocarbon/halometallate ionic liquid mixtures may have sufficient interfacial surface area between the hydrocarbon and halometallate ionic liquid to be useful. In the separation step, the mixture of hydrocarbon and halometallate ionic liquid settles or forms two phases, a hydrocarbon phase and halometallate ionic liquid phase, which are separated to produce a hydrocarbon-immiscible halometallate ionic liquid effluent and a hydrocarbon effluent.

The process may be conducted in various equipment which is well known in the art and is suitable for batch or continuous operation. For example, in a small scale form of the invention, the hydrocarbon, and the hydrocarbon-immiscible halometallate ionic liquid, and organohalide may be mixed in a beaker, flask, or other vessel, e.g., by stirring, shaking, use of a mixer, or a magnetic stirrer. The mixing or agitation is stopped and the mixture forms a hydrocarbon phase and a halometallate ionic liquid phase which can be separated, for example, by decanting, centrifugation, or use of a pipette to produce a hydrocarbon effluent having a lower contaminant content relative to the incoming hydrocarbon. The process also produces a hydrocarbon-immiscible halometallate ionic liquid effluent comprising the one or more contaminants.

The contacting and separating steps may be repeated, for example, when the contaminant content of the hydrocarbon effluent is to be reduced further to obtain a desired contaminant level in the ultimate hydrocarbon product stream from the process. Each set, group, or pair of contacting and separating steps may be referred to as a contaminant removal step. Thus, the invention encompasses single and multiple contaminant removal steps. A contaminant removal zone may be used to perform a contaminant removal step. As used herein, the term "zone" can refer to one or more equipment items and/or one or more sub-zones. Equipment items may include, for example, one or more vessels, heaters, separators, exchangers, conduits, pumps, compressors, and controllers. Additionally, an equipment item can further include one or more zones or sub-zones. The contaminant removal process or step may be conducted in a similar manner and with similar equipment as is used to conduct other liquid-liquid wash and extraction operations. Suitable equipment includes, for example, columns with: trays, packing, rotating discs or plates, and static mixers. Pulse columns and mixing/settling tanks may also be used.

FIG. 1 is a flow scheme illustrating various embodiments of the invention and some of the optional and/or alternate steps and apparatus encompassed by the invention. Hydrocarbon feed stream 2, hydrocarbon-immiscible halometallate ionic liquid stream 4, and organohalide and/or HCl stream 5 are introduced to and contacted and separated in contaminant removal zone 100 resulting in hydrocarbon-immiscible halometallate ionic liquid effluent stream 8 and hydrocarbon effluent stream 6 as described above. In some embodiments, halometallate ionic liquid stream 4 and organohalide or HCl stream 5 can be premixed before being introduced into the contaminant removal zone.

The halometallate ionic liquid stream 4 may be comprised of fresh halometallate ionic liquid stream 3 and/or one or more halometallate ionic liquid streams which are recycled in the process as described below. In an embodiment, a portion or all of hydrocarbon effluent stream 6 is passed via conduit 10 to a hydrocarbon conversion zone 800. Hydrocarbon conversion zone 800 may, for example, comprise at least one of a fluid catalytic cracking and a hydrocracking process, which are well known in the art.

The contacting step can take place at a temperature in the range of about −20° C. to about 200° C., or about 20° C. to about 150° C., or about 20° C. to about 120° C., or about 20° C. to about 100° C., or about 20° C. to about 80° C.

The contacting step takes place in an inert atmosphere, such as nitrogen, helium, argon, and the like, without oxygen or moisture.

The contacting step typically takes place at atmospheric pressure, although higher or lower pressures could be used, if desired. The pressure can be in the range of about 0.1 MPa to about 3 MPa.

The weight ratio of hydrocarbon feed to lean halometallate ionic liquid and organohalide introduced to the contaminant removal step may range from about 1:10,000 to about 10,000:1, or about 1:1,000 to about 1,000:1, or about 1:100 to about 100:1, or about 1:20 to about 20:1, or about 1:10 to about 10:1. In an embodiment, the weight of hydrocarbon feed is greater than the weight of halometallate ionic liquid introduced to the contaminant removal step.

The contacting time is sufficient to obtain good contact between the halometallate ionic liquid and the hydrocarbon feed. The contacting time is typically in the range of about 1 min to about 2 hr, or about 1 min to about 1 hr, or about 5 min to about 30 min. The settling time may range from about 1 min to about 8 hr, or about 1 min to about 2 hr, or about 1 min to about 1 hr, or about 1 min to about 30 min, or about 1 min to about 10 min.

An optional hydrocarbon washing step may be used, for example, to remove halometallate ionic liquid that is entrained or otherwise remains in the hydrocarbon effluent stream 6 by using water to dissolve the halometallate ionic liquid in the hydrocarbon effluent. In this embodiment, a portion or all of hydrocarbon effluent stream 6 (as feed) and a water stream 12 (as solvent) are introduced to hydrocarbon washing zone 400. The hydrocarbon effluent and water streams introduced to hydrocarbon washing zone 400 are mixed and separated to produce a washed hydrocarbon stream 14 and a spent water stream 16, which comprises the dissolved halometallate ionic liquid. The hydrocarbon washing step may be conducted in a similar manner and with similar equipment as used to conduct other liquid-liquid wash and extraction operations as discussed above. Various hydrocarbon washing step equipment and conditions such as temperature, pressure, times, and solvent to feed ratio may be the same as or different from the contaminant removal zone equipment and conditions. In general, the hydrocarbon washing step conditions will fall within the same ranges as given for the contaminant removal step conditions. A portion or all of the washed hydrocarbon stream 14 may be passed to hydrocarbon conversion zone 800.

Figure 2A:
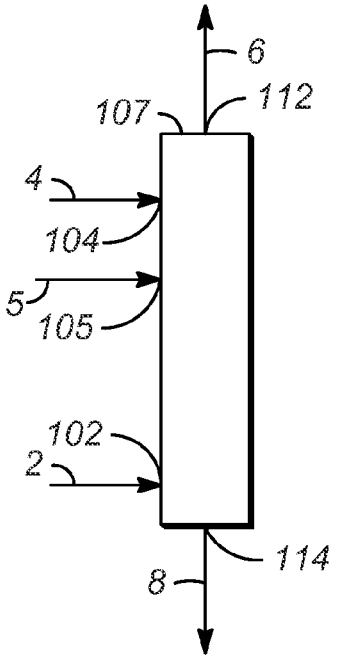
FIGS. 2A and 2B are simplified flow schemes illustrating different embodiments of an extraction zone of the invention.

FIG. 2A illustrates an embodiment of the invention which may be practiced in contaminant removal or extraction zone 100 that comprises a multi-stage, counter-current extraction column 107 wherein hydrocarbon and hydrocarbon-immiscible halometallate ionic liquid are contacted and separated. The hydrocarbon feed stream 2 enters extraction column 107 through hydrocarbon feed inlet 102, lean halometallate ionic liquid stream 4 enters extraction column 107 through halometallate ionic liquid inlet 104, and organohalide stream 5 enters extraction column 107 through organohalide inlet 105. In the Figures, reference numerals of the streams and the lines or conduits in which they flow are the same. Hydrocarbon feed inlet 102 is located below halometallate ionic liquid inlet 104 and organohalide inlet 105. In some embodiments, the halometallate ionic liquid stream 4 and the organohalide stream 5 are mixed together and enter through halometallate ionic liquid inlet 104. The hydrocarbon effluent passes through hydrocarbon effluent outlet 112 in an upper portion of extraction column 107 to hydrocarbon effluent conduit 6. The hydrocarbon-immiscible halometallate ionic liquid effluent including the contaminants removed from the hydrocarbon feed passes through halometallate ionic liquid effluent outlet 114 in a lower portion of extraction column 107 to halometallate ionic liquid effluent conduit 8.

Figure 2B:
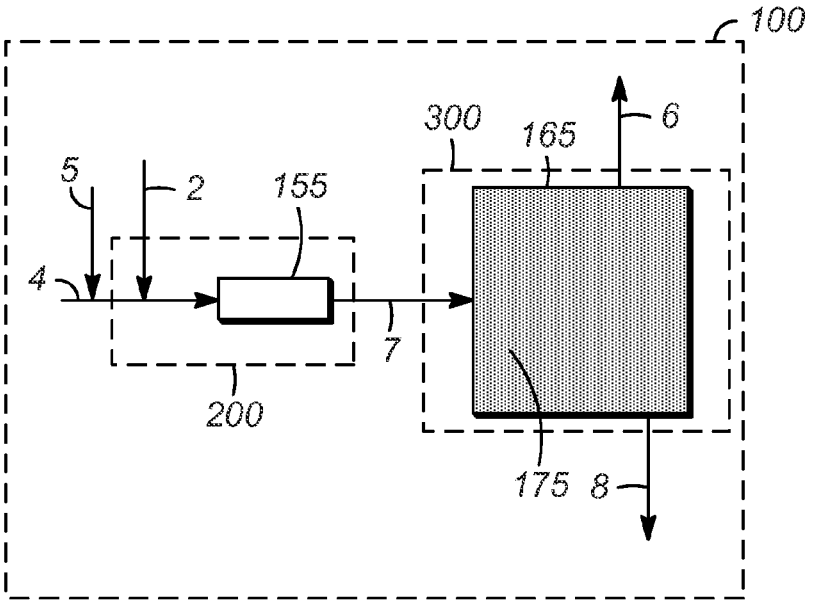

FIG. 2B illustrates another embodiment of contaminant removal zone 100 that comprises a contacting zone 200 and a separation zone 300. In this embodiment, lean halometallate ionic liquid stream 4, organohalide stream 5, hydrocarbon feed stream 2 are introduced into the contacting zone 200 and mixed by introducing organohalide stream 5 and hydrocarbon feed stream 2 into the flowing lean halometallate ionic liquid stream 4 and passing the combined streams through static in-line mixer 155. Static in-line mixers are well known in the art and may include a conduit with fixed internals such as baffles, fins, and channels that mix the fluid as it flows through the conduit. In other embodiments, not illustrated, lean halometallate ionic liquid stream 4 and organohalide stream 5 (either separately or premixed) may be introduced into hydrocarbon feed stream 2. In another embodiment, lean halometallate ionic liquid stream 4, organohalide stream 5, and hydrocarbon feed stream 2 are separately introduced into the static in-line mixer 155. In other embodiments, the streams may be mixed by any method well known in the art, including stirred tank and blending operations. The mixture comprising hydrocarbon, halometallate ionic liquid, and organohalide is transferred to separation zone 300 via transfer conduit 7. Separation zone 300 comprises separation vessel 165 wherein the two phases are allowed to separate into a rich halometallate ionic liquid phase which is withdrawn from a lower portion of separation vessel 165 via halometallate ionic liquid effluent conduit 8 and a hydrocarbon phase which is withdrawn from an upper portion of separation vessel 165 via hydrocarbon effluent conduit 6. Separation vessel 165 may comprise a boot, not illustrated, from which rich halometallate ionic liquid is withdrawn via conduit 8.

Separation vessel 165 may contain a solid media 175 and/or other coalescing devices which facilitate the phase separation. In other embodiments, the separation zone 300 may comprise multiple vessels which may be arranged in series, parallel, or a combination thereof. The separation vessels may be of any shape and configuration to facilitate the separation, collection, and removal of the two phases. In a further embodiment, contaminant removal zone 100 may include a single vessel wherein lean halometallate ionic liquid stream 4, organohalide stream 5, and hydrocarbon feed stream 2 are mixed, and then remain in the vessel to settle into the hydrocarbon effluent and rich halometallate ionic liquid phases.

In an embodiment, the process comprises at least two contaminant removal steps. For example, the hydrocarbon effluent from one contaminant removal step may be passed directly as the hydrocarbon feed to a second contaminant removal step. In another embodiment, the hydrocarbon effluent from one contaminant removal step may be treated or processed before being introduced as the hydrocarbon feed to the second contaminant removal step. There is no requirement that each contaminant removal zone comprises the same type of equipment. Different equipment and conditions may be used in different contaminant removal zones.

The contaminant removal step may be conducted under contaminant removal conditions including temperatures and pressures sufficient to keep the hydrocarbon-immiscible halometallate ionic liquid and hydrocarbon feeds and effluents as liquids. When the hydrocarbon-immiscible halometallate ionic liquid comprises more than one halometallate ionic liquid component, the decomposition temperature of the halometallate ionic liquid is the lowest temperature at which any of the halometallate ionic liquid components decompose. The contaminant removal step may be conducted at a uniform temperature and pressure, or the contacting and separating steps of the contaminant removal step may be operated at different temperatures and/or pressures. In an embodiment, the contacting step is conducted at a first temperature, and the separating step is conducted at a temperature at least 5° C. lower than the first temperature. In a non-limiting example, the first temperature is about 35° C. Such temperature differences may facilitate separation of the hydrocarbon and halometallate ionic liquid phases.

The above and other contaminant removal step conditions such as the contacting or mixing time, the separation or settling time, and the ratio of hydrocarbon feed to hydrocarbon-immiscible halometallate ionic liquid (lean halometallate ionic liquid) may vary greatly based, for example, on the specific halometallate ionic liquid or liquids and organohalides employed, the nature of the hydrocarbon feed (straight run or previously processed), the contaminant content of the hydrocarbon feed, the degree of contaminant removal required, the number of contaminant removal steps employed, and the specific equipment used.

The degree of phase separation between the hydrocarbon and halometallate ionic liquid phases is another factor to consider as it affects recovery of the halometallate ionic liquid and hydrocarbon. The degree of contaminant removed and the recovery of the hydrocarbon and halometallate ionic liquid may be affected differently by the nature of the hydrocarbon feed, the variations in the specific halometallate ionic liquid or liquids, the organohalide used, the equipment, and the contaminant removal conditions such as those discussed above.

The amount of water present in the hydrocarbon/hydrocarbon-immiscible halometallate ionic liquid mixture during the contaminant removal step may also affect the amount of contaminant removed and/or the degree of phase separation, i.e., recovery of the hydrocarbon and halometallate ionic liquid. When water is present, the ionic liquid is less effective and the lifetime will be shortened. It will be quenched by the wet hydrocarbon passing over it and making metal hydroxide salts. In an embodiment, the hydrocarbon/hydrocarbon-immiscible halometallate ionic liquid mixture has a water content of less than about 1 mol % relative to the halometallate ionic liquid, or less than about 0.5%, or less than about 0.2%, or less than about 0.1%, or less than 0.075%, or less than 0.05%. In a further embodiment, the hydrocarbon/hydrocarbon-immiscible halometallate ionic liquid mixture is water free, i.e., the mixture does not contain water.

Unless otherwise stated, the exact connection point of various inlet and effluent streams within the zones is not essential to the invention. For example, it is well known in the art that a stream to a distillation zone may be sent directly to the column, or the stream may first be sent to other equipment within the zone such as heat exchangers, to adjust temperature, and/or pumps to adjust the pressure. Likewise, streams entering and leaving contaminant removal, and washing zones may pass through ancillary equipment such as heat exchanges within the zones. Streams may be introduced individually or combined prior to or within such zones.

The invention encompasses a variety of flow scheme embodiments including optional destinations of streams, splitting streams to send the same composition, i.e. aliquot portions, to more than one destination, and recycling various streams within the process. The various process steps may be operated continuously and/or intermittently as needed for a given embodiment e.g. based on the quantities and properties of the streams to be processed in such steps. As discussed above the invention encompasses multiple contaminant removal steps, which may be performed in parallel, sequentially, or a combination thereof. Multiple contaminant removal steps may be performed within the same contaminant removal zone and/or multiple contaminant removal zones may be employed with or without intervening washing zones.

By the term "about," we mean within 10% of the value, or within 5%, or within 1%.

Example 1

Nitrogen and Sulfur Removal from Vacuum Gas Oil (VGO) with Ionic Liquid (IL)

In a vial in a nitrogen glovebox, the tributylhexylphosphonium (TBHP) $Al_2Cl_7$ IL was added to the VGO (5:1 weight ratio of VGO to IL). The appropriate amount of tert-butylchloride (tBuCl) was added to the mixture. The mixture was stirred at 80° C. for 30 min, and then allowed to settle. The VGO was decanted from the ionic liquid and analyzed for S and N content.

TABLE 1

| VGO | TBHP$Al_2Cl_7$ | TBHP $Al_2Cl_7$ + 10 wt % tBuCl | TBHP $Al_2Cl_7$ + 20 wt % tBuCl | TBHP $Al_2Cl_7$ + 30 wt % tBuCl |
|---|---|---|---|---|
| Nitrogen ppm in Starting Feed | 23293 | 23293 | 23293 | 23293 |
| Sulfur ppm in Starting feed | 1400 | 1400 | 1400 | 1400 |
| Nitrogen wt % Removed | 89 | 95 | 95 | 93 |
| Sulfur wt % Removed | 25 | 28 | 32 | 32 |

Example 2

Nitrogen and Sulfur Removal from Hydrotreated VGO with IL

In a vial in a nitrogen glovebox, the IL was added to the VGO (5:1 weight ratio of hydrotreated VGO to IL). The appropriate amount of tBuCl was added to the mixture. The mixture was stirred at 80° C. for 30 min then allowed to settle. The VGO was decanted from the ionic liquid and analyzed for S and N content.

TABLE 2

| Hydrotreated VGO | TBHP$Al_2Cl_7$ | TBHP $Al_2Cl_7$ + 10 wt % tBuCl |
|---|---|---|
| Nitrogen ppm in Starting Feed | 486 | 486 |
| Sulfur ppm in Starting feed | 1859 | 1859 |
| Nitrogen wt % Removed | 83 | 97 |
| Sulfur wt % Removed | 3 | 37 |

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A process for removing a contaminant comprising at least one of sulfur and nitrogen from a hydrocarbon stream comprising:

contacting the hydrocarbon stream comprising the contaminant with a lean hydrocarbon-immiscible halometallate ionic liquid and an organohalide or HCl resulting in a mixture comprising the hydrocarbon and a rich hydrocarbon-immiscible halometallate ionic liquid comprising the contaminant wherein the hydrocarbon-immiscible halometallate ionic liquid comprises a haloaluminate ionic liquid, a haloferrate ionic liquid, a halocuprate ionic liquid, a halozincate ionic liquid, or combinations thereof and wherein the aloaluminate in said haloaluminate ionic liquid is selected from the group consisting of $Al_2Cl_7^-$, $Al_3Cl_{10}^-$, $Al_2Cl_6Br$, $Al_3Cl_9Br$, $Al_2Br_7^-$, and $Al_3Br_{10}$; and separating the mixture to produce a hydrocarbon effluent and a rich hydrocarbon-immiscible halometallate ionic liquid effluent comprising the rich hydrocarbon-immiscible halometallate ionic liquid comprising the contaminant.

2. The process of claim 1 wherein the hydrocarbon-immiscible halometallate ionic liquid comprises at least one of nitrogen containing ionic liquids and phosphorus containing ionic liquids.

3. The process of claim 1 wherein the hydrocarbon-immiscible halometallate ionic liquid comprises an imidazolium ionic liquid, an ammonium ionic liquid, a pyridinium ionic liquid, a phosphonium ionic liquid, a pyrrolidinium ionic liquid, a lactamium ionic liquid, or combinations thereof.

4. The process of claim 1 wherein the organohalide comprises an alkyl halide, an isoalkyl halide, a cycloalkyl halide, or combinations thereof.

5. The process of claim 1 wherein the organohalide comprises tert-butyl chloride, tert-butyl bromide, 2-chlorobutane, 2-bromobutane, cyclopentyl chloride, cyclopentyl bromide, butyl chloride, butyl bromide, propyl chloride, propyl bromide, or combinations thereof.

6. The process of claim 1 where the organohalide is present in an amount between about 1 wt % and about 50 wt % of an amount of ionic liquid.

7. The process of claim 1 wherein the organohalide has 1-12 carbon atoms.

8. The process of claim 1 wherein the hydrocarbon stream has a boiling point in a range of about 30° C. to about 610° C.

9. The process of claim 1 wherein the contacting step is conducted under at least one of: a temperature in a range of about −20° C. to about 100° C., a pressure in a range of about 0.1 MPa to about 3 MPa, and an inert atmosphere.

10. The process of claim 1 further comprising passing at least a portion of the hydrocarbon effluent to a hydrocarbon conversion zone.

11. The process of claim 1 wherein a weight ratio of the hydrocarbon stream to the hydrocarbon-immiscible halometallate ionic liquid and the organohalide is in a range of about 1:1,000 to about 1,000:1.

12. A process for removing a contaminant comprising at least one of sulfur and nitrogen from a hydrocarbon stream comprising:

contacting the hydrocarbon stream comprising the contaminant with a lean hydrocarbon-immiscible halometallate ionic liquid and an organohalide or HCl resulting in a mixture comprising the hydrocarbon and a rich hydrocarbon-immiscible halometallate ionic liquid comprising the contaminant, wherein the hydrocarbon-immiscible halometallate ionic liquid comprises an imidazolium ionic liquid, an ammonium ionic liquid, a pyridinium ionic liquid, a phosphonium ionic liquid, a pyrrolidinium ionic liquid, a lactamium ionic liquid, or combinations thereof, and wherein the organohalide comprises an alkyl halide, an isoalkyl halide, a cycloalkyl halide, or combinations thereof; and separating the mixture to produce a hydrocarbon effluent and a rich hydrocarbon-immiscible halometallate ionic liquid effluent comprising the rich hydrocarbon-immiscible halometallate ionic liquid comprising the contaminant; wherein the hydrocarbon-immiscible halometallate ionic liquid comprises a haloaluminate ionic liquid, a haloferrate ionic liquid, a halocuprate ionic liquid, a halozincate ionic liquid, or combinations thereof and wherein the aloaluminate in said haloaluminate ionic liquid is selected from the group consisting of $Al_2Cl_7^-$, $Al_3Cl_{10}^-$, $Al_2Cl_6Br$, $Al_3Cl_9Br$, $Al_2Br_7^-$, and $Al_3Br_{10}$.

13. The process of claim 12 wherein the organohalide comprises tert-butyl chloride, tert-butyl bromide, 2-chlorobutane, 2-bromobutane, cyclopentyl chloride, cyclopentyl bromide, butyl chloride, butyl bromide, propyl chloride, propyl bromide, or combinations thereof.

14. The process of claim 12 where the organohalide is present in an amount between 1 wt % and 50 wt % of an amount of ionic liquid.

15. The process of claim 12 wherein the hydrocarbon stream has a boiling point in a range of about 30° C. to about 610° C.

16. The process of claim 12 wherein the contacting step is conducted under at least one of a temperature in a range of about −20° C. to about 100° C., a pressure in a range of about 0.1 MPa to about 3 MPa, and an inert atmosphere.

17. The process of claim 12 wherein a ratio of the hydrocarbon stream to the hydrocarbon-immiscible halometallate ionic liquid and the organohalide is in a range of about 1:1,000 to about 1,000:1.

18. The process of claim 12 further comprising passing at least a portion of the hydrocarbon effluent to a hydrocarbon conversion zone.

* * * * *